US008160278B2

(12) United States Patent
Christoph et al.

(10) Patent No.: US 8,160,278 B2
(45) Date of Patent: Apr. 17, 2012

(54) MIXING SYSTEM

(75) Inventors: Markus Christoph, Straubing (DE); Florian Wolf, Regensberg (DE); Peter Perzlmaier, Regensburg (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 759 days.

(21) Appl. No.: 12/269,391

(22) Filed: Nov. 12, 2008

(65) Prior Publication Data

US 2009/0214058 A1 Aug. 27, 2009

(30) Foreign Application Priority Data

Nov. 12, 2007 (EP) ..... 07021940

(51) Int. Cl.
*H04R 5/00* (2006.01)

(52) U.S. Cl. ..... 381/119; 381/71.11

(58) Field of Classification Search ..... 381/119, 381/1, 17–23, 71.11, 97, 98
See application file for complete search history.

(56) References Cited

U.S. PATENT DOCUMENTS

| | | | | |
|---|---|---|---|---|
| 5,724,485 | A * | 3/1998 | Rainton | 706/14 |
| 7,283,634 | B2 * | 10/2007 | Smith | 381/20 |
| 7,929,708 | B2 * | 4/2011 | Reams et al. | 381/17 |
| 2002/0071574 | A1 | 6/2002 | Aylward et al. | |
| 2003/0125823 | A1 * | 7/2003 | Abe et al. | 700/94 |
| 2006/0045291 | A1 | 3/2006 | Smith | |

FOREIGN PATENT DOCUMENTS

GB 2 330 048 A 4/1999

* cited by examiner

*Primary Examiner* — Kiesha Bryant
*Assistant Examiner* — Eric Ward
(74) *Attorney, Agent, or Firm* — Brinks Hofer Gilson & Lione

(57) ABSTRACT

A system automatically mixes a first audio signal and a second audio signal. The system includes a correlator that determines whether the first signal and the second signal are correlated according to a predetermined correlation criterion. If the predetermined correlation criterion is fulfilled, the correlator determines whether the first and the second signal are delayed. A delay circuit compensates for the delay between the first signal and the second signal. A mixer mixes the first signal and the second signal that includes a compensation.

18 Claims, 6 Drawing Sheets

MIXING SYSTEM

PRIORITY CLAIM

This application claims the benefit of priority from European Patent 07021940.7 dated Nov. 12, 2007, which is incorporated by reference.

BACKGROUND OF THE INVENTION

1. Technical Field

This disclosure is related to systems that mix audio signals.

2. Related Art

Systems may combine audio signals from many sources. The signals may be transmitted in different channel formats (e.g., a 3 channel or a 5.1 channel formats. When a 5.1 format is converted into audible sound through two loudspeakers, the underlying audio channels are combined. When two channels have equal amplitude but different phase, the combination may attenuate content.

Some systems compensate for signal loss by making constant adjustments during auditory scenes or events. The changes may occur near auditory scene or event boundaries. These systems and other methods may generate or pass audible artifacts that distort signals and mask content.

SUMMARY

A system mixes a first audio signal and a second audio signal. The system includes a correlator that determines whether the first signal and the second signal are correlated according to a predetermined correlation criterion. If the predetermined correlation criterion is fulfilled, the correlator determines whether the first and the second signal are delayed. A delay circuit compensates for the delay between the first signal and the second signal. A mixer mixes the first signal and the second signal that includes a compensation.

Other systems, methods, features and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
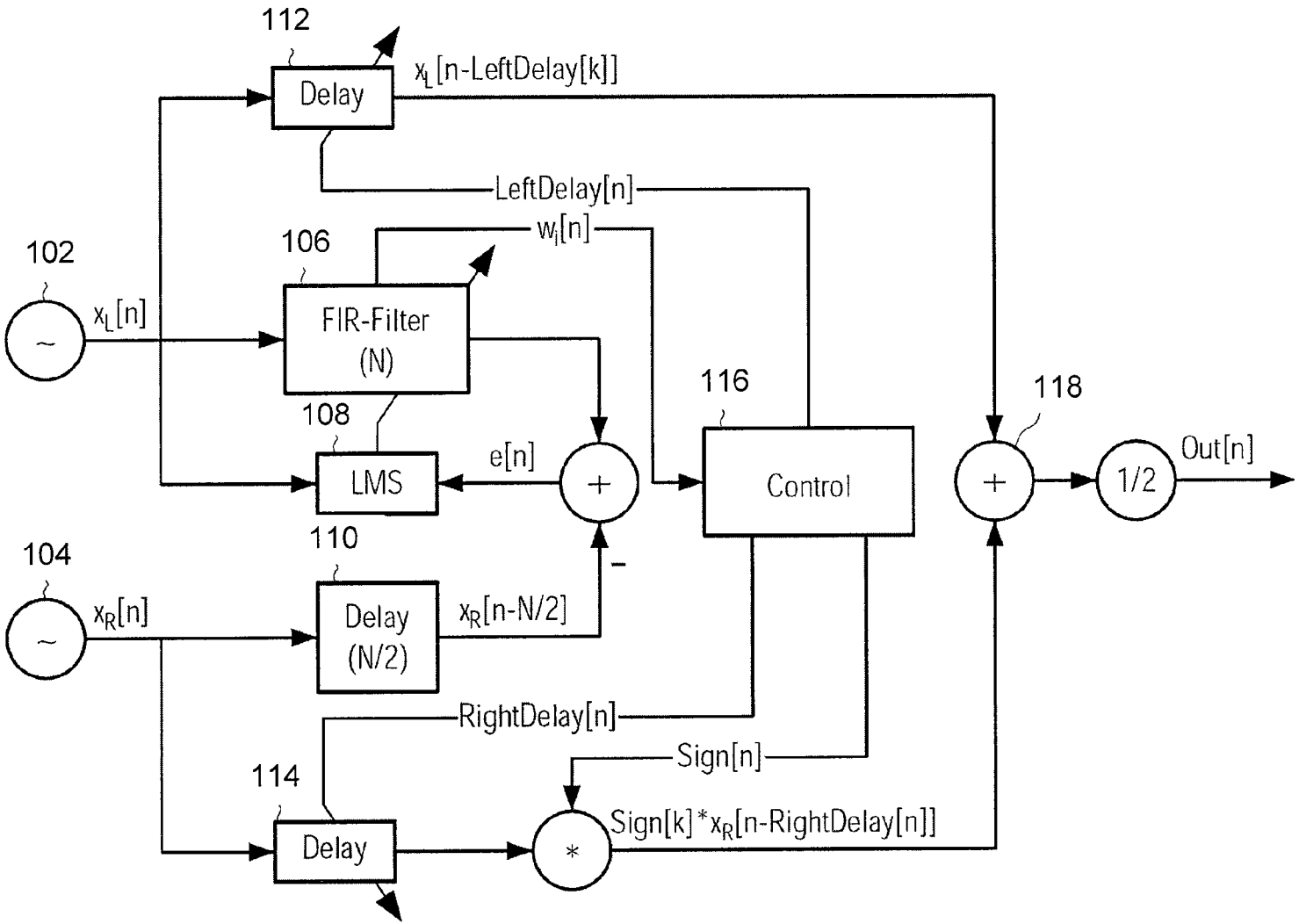
FIG. 1 is a system that combines and adjusts sound from multiple sources.

A system combines and adjusts sounds from a variety of sources. A correlator (or receiver) may receive and measure the similarity between two or more signals. The correlator may determine the correlation between the signals according to a predetermined criterion. When the criterion is fulfilled, the correlator (or receiver) may measure the delay between the signals. A compensator (or delay circuit) may compensate for these delays before a mixing device (or software) combines the sounds into a composite output. The output may comprise a combination or adjustment of time domain, frequency domain, and/or digital domain signals. The system may compensate for undesired changes within waveforms or artifacts that may distort content. The distortion may occur during signal transmission, when a signal passes through a circuit, or when other events cause delays in correlated signals. In some systems, the compensation may occur immediately or concurrently (e.g., in real-time) as delay is detected or measured.

In some systems, the similarities between the signals are determined by a cross-correlation. The cross-correlation may be measured continuously or through segments or blocks in the time or frequency domains. Some correlators select and establish a signal as a reference that may be compared to a second signal. The correlators may selectively pass elements of the reference signal through an adaptive filter like a Finite Impulse Response (FIR) filter. The adaptive filter may be programmed (or configured) to minimize the difference between the reference signal and the comparative signal by a predetermined criterion. The correlator may determine current maximum absolute values of the filter coefficients and whether the filter coefficient positions of the current maximum values and the positions of a predetermined number of previously determined maximum values deviate by no more than a predetermined value. A correlation may be established when the positions of the maximum values deviate by no more than a predetermined value.

If the position of the filter coefficient comprising (or with) the maximum value does not change or changes slightly in time (which may be measured and limited by a deviation threshold value), the correlator identifies a correlating condition between the signals. When one or more of the current maximum value filter coefficient positions, and the predetermined number of positions of previously determined maximum values deviates more than the predetermined threshold value from one of the other determined positions, the correlator may identify an uncorrelated condition.

In some systems a buffer or region of a local or remote memory reserved for use as an intermediate repository may retain the position of the filter coefficients of the maximum value. The memory may replace or write over the oldest position value stored in the buffer. When deviation comparisons occur, the system may compare the stored values.

In some systems, correlation may be measured through more than one comparison. Some correlators select and designate a first signal as the reference signal and designate the second signal as the comparative signal. When processed (e.g., the delay is measured), the correlators may re-designate the second signal as the reference signal and re-designate the first signal to be the comparative signal. Through this process (and analysis) variant causal conditions may be identified.

To measure delay, some systems may program or configure a delay circuit or element to delay a comparative signal by about half of the length of the adaptive filter. The adaptive filter may be programmed or configured to minimize the difference between the reference signal and the delayed comparative signal according to a predetermined value (e.g., criterion). The system may determine whether the maximum value of the position of the filter coefficient is located above or below half of the filter length of the adaptive filter. Through this analysis the system may determine which of the signals are delayed. An absolute value of the filter coefficient position less half (or about one half) of the filter length may yield the delay.

To determine relative position of the maximum value to the half filter length of the adaptive filter, the system may determine a median of a current and a predetermined number of previously determined maximum value positions. The system may then determine the differences between the median and the value of half of the filter length through an adder or subtractor. When the difference is positive, the comparative signal may be delayed by the difference value to compensate for the delay of the reference signal. When the difference value is negative, the comparative signal may be delayed by the absolute value of the difference value.

The systems may determine when a second signal is in phase or out of phase with a first signal (e.g., through a phase detector or filter). When the second signal is out of phase, the system may change the phase of one of the signals. A phase measurement may be based on an impulse response of the adaptive filter. When a maximum value of an impulse response (of all filters coefficients) is positive, the system may designate the first and second signal to be in phase. When the maximum value of the impulse response is negative, the system may designate the signals to be out of phase. In some applications, changing the phase of a signal may comprise changing the sign (or polarity) of one of the signals. To avoid errors caused by a vanishing comparative result, some systems measure correlation and apply compensation only when the level of a comparative signal is above a pre-determined threshold or signal level.

In some applications, an alternative system may add a predetermined noise signal (having a predetermined power) to the comparative signal to obtain an augmented comparative signal. The adaptive filter may be configured so that the difference between the reference signal and the augmented comparative signal is minimized. Through this augmentation the comparative signal may not fall below a predetermined threshold established by the predetermined power of the noise signal. In some alternative systems, an adaptive filter is programmed to adapt only when the comparative signal is greater than or equal to a predetermined threshold. Through this alternative, compensating parameters may be maintained when the comparative signal vanishes or has a minimal amplitude.

In each of the above systems (and methods) correlation may be measured at asynchronous, regular, synchronous, or sample intervals. In these systems correlation measurements and compensation applications may occur in the time domain. In some systems, mixing may occur in the frequency domain. An alternative system may first transform the first signal and the second signal into the frequency domain. A short-time Fourier transform (e.g., an overlap-add method) may convert a signal to the frequency domain. Portions of the frequency domain may be selected through windowing functions (e.g., a Hamming window) that pass portions of the first and second audio signal.

For each frequency or frequency range (out of a set of frequencies or frequency ranges), the system may determine whether the amplitude of the second signal fulfils or exceeds a predetermined amplitude criterion. A mixing may be performed for each frequency or frequency range of a set. In some systems, when the predetermined amplitude criterion is fulfilled, the phase of the output signal for the respective frequency or frequency range may correspond to the phase of the second signal.

By accounting for the amplitude at each frequency (or frequency range, or bin, etc.) of the second signal when making phase decisions, (e.g., when deciding whether to adopt the phase of the second signal as the output phase at a particular frequency), artifacts may be reduced. By applying the amplitude criterion separately at each frequency or frequency range, a very specific phase and efficient adaptation is achieved.

In some systems, a domain change may occur through a short-time Fourier transform. When transformed to the frequency domain an amplitude criterion and a corresponding mixing may be performed. When combined, the output may be converted to the time domain.

In some systems the process of determining whether the amplitude of the second signal fulfils a predetermined amplitude criterion need not occur when determining whether the signals are correlated and whether the signals are delayed. Some systems may transform the first signal and the second signal into the frequency domain. The systems may determine when the amplitude of the second signal fulfils a predetermined amplitude criterion for each frequency or frequency range. The system may mix the first signal and the second signal. If the predetermined amplitude criterion is fulfilled, the phase of the output signal may correspond to the phase of the second signal.

The predetermined amplitude criterion may comprise verifying whether the amplitude of the second signal is larger than a predetermined threshold value and/or larger than the amplitude of the first signal by a predetermined threshold value. When one or more verifications (for a particular frequency or frequency range) yield a positive result, the predetermined amplitude criterion may be fulfilled. These criteria may ensure that the second signal (at that particular frequency or frequency range) makes a significant contribution to the combined or output signal. In these conditions the system may designate or adopt the phase of the second signal as the output phase of a portion of the output signal. In this application, the two predetermined threshold values may differ.

Under many conditions, systems may mix the first and second signal such that the phase of the output signal for a particular frequency or frequency range corresponds to or is about equal to the phase of the second signal. In some systems, a filter may selectively pass certain elements of the first signal that are added to the second signal. In these systems the phase of the filtered signal may corresponds to the phase of the second signal.

In some applications, an output of the system may comprise a weighted sum. For each frequency or frequency range, an output signal may be based on a sum of the second signal and of the second signal weighted by the ratio of the absolute values of the first and the second signals. The output signal may equal a factor (e.g., about 0.5) times the sum of the second signal and a product. The product may comprise the multiplication of the second signal and ratio of the absolute values of the first and the second signal.

When a predetermined amplitude criterion is not fulfilled, the phase of the output signal may correspond to the phase of the first signal. When comparing the amplitude of the second signal to a predetermined threshold value and/or the amplitude of the first signal, a negative verification may indicate that the contribution of the first signal to the combined signal is predominant. Under these conditions, the phase of the output may correspond to the phase of the first signal.

In the systems described, a mixing may be performed after the systems compensates for a delay. Delay compensation may precede transforming the first signal and the second signal into the frequency domain, and mixing the first signal and the second signal.

Some alternative systems automatically mix a first and a second audio signal through a correlator. The correlator may determine when the first signal and the second signal are correlated according to a predetermined correlation criterion. When the predetermined correlation criterion is fulfilled, the correlator may determine when the first and the second signal are delayed (with respect to each other). A delay device may compensate for the delay between the signals. A mixer may then mix the first signal and the second signals.

In some alternative systems, a first signal or second signal may be selected and designated as a reference signal and the other signal may be selected and designated as a comparative signal. The correlator may include an adaptive filter that receives the reference signal. The adaptive filter may be configured so that the difference between the reference signal and the comparative signal is minimized to a predetermined criterion. A controller may receive filter coefficients of the adaptive filter. The controller may determine a current maximum value of the absolute values of the filter coefficients. The controller may further determine whether the filter coefficient position of the current maximum value and the positions of a predetermined number of previously determined maximum values deviate at most by a predetermined threshold value. The controller may determine that the first and the second signal are correlated when the positions of maximum values deviate at most by the predetermined threshold value.

In some systems the adaptive filter may be a FIR filter. The system may include a buffer for storing a predetermined number of positions of filter coefficients. The correlator may include a delay element that delays the comparative signal by half (or about half) of the length of the adaptive filter to output a delayed comparative signal. The adaptive filter may minimize the difference of the reference signal and the delayed comparative signal according to the predetermined criterion. The control element may determine when the filter coefficient position of the maximum value is located above or below half of the filter length of the adaptive filter. In some systems a phase measurement may determine when the second signal is in phase or out of phase with the first signal. When the second signal is out of phase with the first signal, a phase detector may initiate a phase change of one of the signals. A phase change may change the sign or polarity of the signal.

Some alternative systems mix a first audio signal and a second audio signal by transforming the first signal and the second signal into the frequency domain. An amplitude criterion method may determine (for each frequency or frequency range out of a set of frequencies or frequency ranges) whether the amplitude of the second signal fulfils a predetermined amplitude criterion. A mixing process may mix the first signal and the second signal. At each frequency or frequency range of a set, when a predetermined amplitude criterion is fulfilled, the phase of the output signal may correspond to the phase of the second signal.

In some methods an amplitude process may verify whether the amplitude of the second signal is larger than a predetermined threshold value and/or when the amplitude of the first signal is larger than a predetermined threshold value. In some methods, a mixing process may add the second signal to a weighted version of the signal. The weighted version may be modified by the second signal weighted by the ratio of the absolute values of the first and the second signals.

FIG. 1 is a system that combines and adjusts sound from multiple sources. Sound is received from a left signal source 102 and a right signal source 104 that provide a first audio signal $x_N[n]$ and a second audio signal $x_R[n]$, respectively. Before mixing the first and second audio signals, the system may determine whether the two audio signals are correlated and delayed with respect to each other in the time domain.

Some systems determine a cross-correlation block-wise in the time domain (or alternatively, in the frequency domain). Alternative systems continuously or synchronously monitor a cross-correlation through a recursive process that may use the continuous cross-correlator of FIG. 1.

In FIG. 1, an adaptive filter 106 (e.g., a FIR filter) receives a first audio signal $x_L[n]$ through an input. The first audio signal may be selected and designated as the reference signal. The second audio signal $x_R[n]$ is selected and designated as a comparative signal. The adaptive filter 106 is configured to minimize the difference e[n] of the reference signal and the comparative signal according to a Least Mean Squares (LMS) device at 108.

The length of the adaptive filter 106 may be selected in many ways. If a maximum delay to be compensated for is equal to 64 samples, an exemplary adaptive filter may have a length of 128 samples to determine which of the audio signals is delayed (with respect to the other signal). If larger delays are expected, an exemplary filter length of at least 256 samples may be used.

The filter coefficients may be adapted continuously. The filter may but need not be adapted at each sample. In some systems, the filter may adapt every 64 samples to reduce the systems computational requirements. At regular time intervals, for example about every 0.25 s, the filter coefficients $w_i[n]$, i=1, . . . , N may be read and a maximum search is performed on these coefficients.

The position of the filter coefficients (where the maximum of the absolute values of the filter coefficients has been found) may be stored in a buffer. The buffer may have a predetermined length, for example about L=5. When buffering the positional value, the oldest entry within the buffer may be replaced by the current position value. This process may ensure that a predetermined number L of maximum positional values are retained in the buffer.

The values within the buffer may be compared to determine whether they deviate from each other by, at most, a predetermined threshold value. In some systems the threshold value may comprise one sample. If each of the buffered values do not deviate from each other by more than this threshold value, the reference signal $x_L[n]$ and the comparative signal $x_R[n]$ are designated correlated. However, if one of the values buffered differs from one of the other values by more than the threshold value, the two audio signals are designated uncorrelated.

If the two signals are correlated, some systems may determine which of the signals are delayed with respect to the other. In some applications, the system may perform the above-described process twice, where $x_L[n]$ is designated as the reference signal through a first iteration and $x_R[n]$ is used as the reference signal for the adaptive filter in a second iteration. When signals are correlated, one of these alternatives will yield causal conditions for the filter. Based on this process, the system determines which of the signals is delayed with respect to the other signal.

An alternative system is shown in FIG. 1. In this system, a delay element 110 may receive the comparative signal $x_R[n]$. The delay element 110 may delay the comparative signal by half (or nearly one half) of the length of the adaptive filter (e.g., by N/2). A clear determination may be made by the number of samples one of the signals is delayed with respect to the other depending on whether the position of the maximum value of the filter coefficients is located above or below half of the filter length.

If the audio signals are correlated, the median of the positions being buffered in the buffer is determined. From this median, half of the filter length e.g., N/2, may be subtracted. If the resulting value is positive, the reference signal $x_L[n]$ will be delayed by a delay element 112. If the value is negative, the comparative signal will be delayed by the corresponding absolute value by delay element 114. While one of the signals may be delayed, the other signal will not be delayed.

The impulse response of the adaptive filter may determine whether the two audio signals are in phase or out of phase. If the maximum of the filter coefficients is positive, both audio signals will be in phase. If the maximum is negative, the two signals are out of phase which may be compensated by changing the phase of one of the signals. In some applications, the sign of a comparative signal $x_R[n]$ is changed.

In FIG. 1, a control element 116 controls the delay and the sign change through the different signal paths. The control may be based on the filter coefficients received from the adaptive filter 106. The resulting, delay compensated signals $x_L[n-LeftDelay[k]]$ and $x_R[n-RightDelay[k]]$, the latter possibly being phase corrected through a sign function, are passed to the mixing or combining component 118. After a power adjustment using a factor of ½, the resulting signal Out[n] is obtained.

Figure 2:
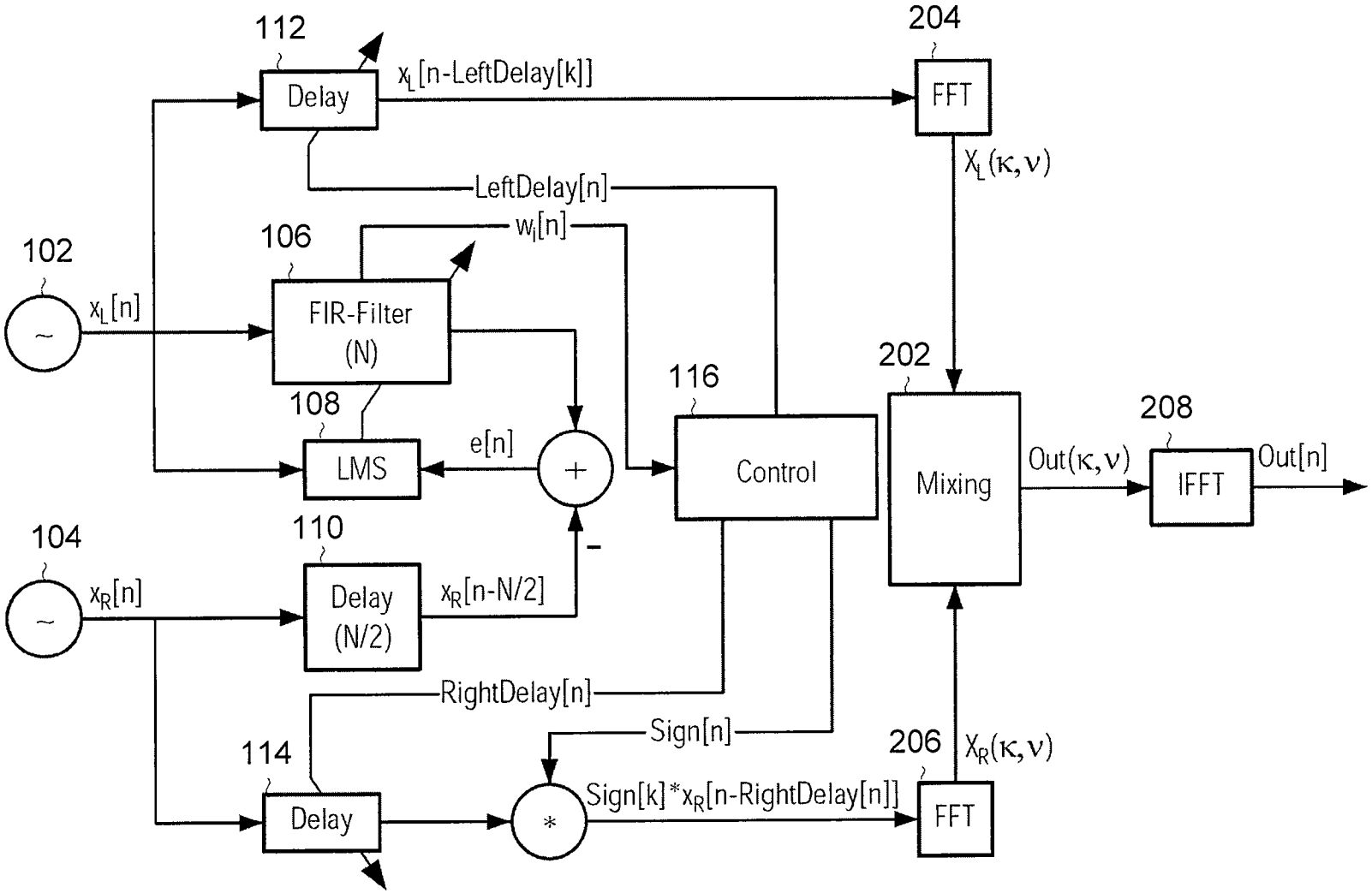
FIG. 2 is an alternative system that combines and adjusts sound from multiple sources.

FIG. 2 is an alternative system that combines and adjusts sound from multiple sources. In FIG. 2, a left signal source 102 and a right signal source 104 are received and passed as a first audio signal $x_N[n]$ and a second audio signal $x_R[n]$, respectively. Before mixing the first and second audio signals, the systems determine whether the two audio signals are correlated and delayed with respect to each other.

An adaptive FIR filter 106 may receive the first audio signal. The first audio signal may be selected as the reference signal and the second audio signal $x_R[n]$ may be selected as a comparative signal. The adaptive filter 106 may minimize the difference e[n] between the reference signal and the comparative signal according to a Least Mean Squares (LMS) device at 108.

In FIG. 2, the length of the adaptive filter is not limited to a single process as it may be selected multiple ways. The filter coefficients may be adapted continuously. At regular or synchronous time intervals, for example about every 0.25 s, the filter coefficients $w_i[n]$; i=1, . . . , N may be read, and a maximum search may be performed on the filter coefficients.

The values retained in the buffer are compared to determine whether they deviate from each other at most by a predetermined threshold value. This threshold value, for example, may be based on one sample. If each of the buffered values does not deviate from the other by more than a threshold value, the reference signal $x_L[n]$ and the comparative signal $x_R[n]$ are correlated. However, if one of the values buffered differs from another value by more than the threshold value, the two audio signals are uncorrelated.

If the two signals are correlated, the system determines which of the signals are delayed with respect to the other. A delay element 110 may receive the comparative signal $x_R[n]$. The delay element 110 may delay the comparative signal by about half of the length of the adaptive filter e.g., by about N/2.

When the audio signals are designated as correlated, the median of the positions being buffered in the buffer is determined. From this median, half of the filter length e.g., about N/2, is subtracted (e.g., a subtractor). If the resulting value is positive, the reference signal $x_L[n]$ may be delayed by a delay element 112. If the value is negative, the comparative signal will be delayed by the corresponding absolute value through delay element 114.

The impulse response of the adaptive filter may determine whether the two audio signals are in or out of phase. If the maximum of the filter coefficients is positive, both audio signals are substantially or in phase. If the maximum is negative, the two signals are out of phase which may be compensated by changing the phase of one of the signals. In FIG. 2, the sign of the comparative signal $x_R[n]$ is changed.

The control element 116 controls the delay and the sign change along the different signal paths. The control may be based on the filter coefficients received from the adaptive filter 106.

The delay compensated signals may be transformed into the frequency domain by a short-time Fast Fourier Transform at 204 and 206. The resulting signals $X_L(\kappa,\nu)$ and $X_R(\kappa,\nu)$ are transmitted to the mixing or combining device 202. In one application, the mixing of the signals may be performed by the system of FIG. 6.

Figure 6:
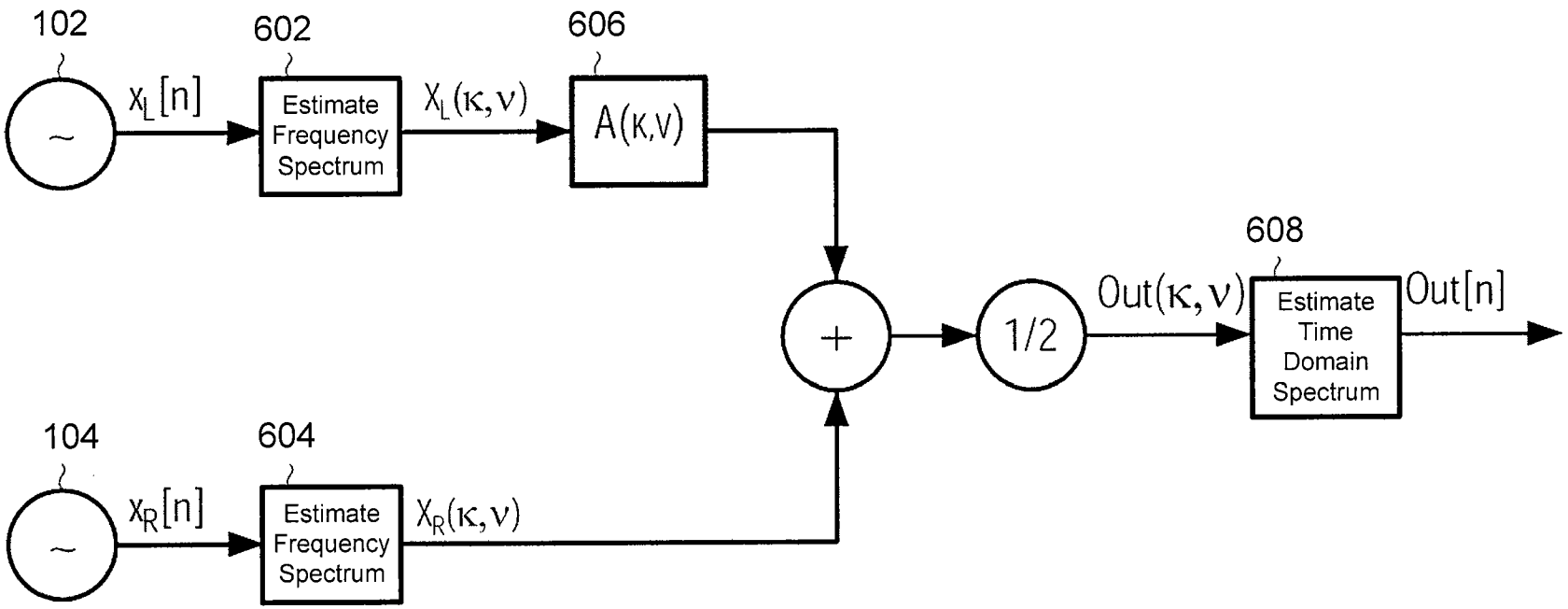
FIG. 6 is a method of mixing first and second audio signals.

In FIG. 6, an audio signal from a left signal source 102 and another audio signal from a right signal source 104 are mixed. The corresponding signals $x_N[n]$ and $x_R[n]$ undergo a Fast Fourier Transform (FFT) by an FFT device at 602 and 604.

The resulting signals (in the frequency domain) are denoted by $X_L(\kappa,\nu)$ and $X_R(\kappa,\nu)$. A filter $A(\kappa,\nu)$ may be applied to $X_L(\kappa,\nu)$. This filter may apply the phase of the signal $x_R[n]$ to the signal $x_L[n]$ without changing the amplitude response of the other signal. After the filter, the signal may have a phase of $x_R[n]$. After summing and weighting the signals, a signal $Out(\kappa,\nu)$ may be obtained which becomes Out[n] after an inverse Fourier transform (IFFT) by an IFFT device 606. This output signal may have a mean absolute value frequency response of $x_L[n]$ and $x_R[n]$ and the phase of $x_R[n]$. The filter 605 may have a transfer function described as:

$$A(\kappa,\nu)=\frac{X_R(\kappa,\nu)|X_L(\kappa,\nu)|}{X_L(\kappa,\nu)|X_R(\kappa,\nu)|}$$

In an alternative system, the output signal in the frequency domain may be determined as $$\mathrm{Out}(\kappa,\nu)=\frac{1}{2}\left(\frac{|X_L(\kappa,\nu)|X_R(\kappa,\nu)}{|X_R(\kappa,\nu)|}+X_R(\kappa,\nu)\right).$$

In this alternative, for each frequency range or bin resulting from the short-time Fourier transform, the alternative system determines whether the amplitude of one of the signals $X_L(\kappa,\nu)$ and $X_R(\kappa,\nu)$ is larger than the amplitude of the other signal by a predetermined threshold value. As an example, a threshold of about −1 dB may be chosen. For this particular bin, the phase of the signal with the larger amplitude is selected for the output signal $Out(\kappa,\nu)$, for example, by applying this phase to the signal that has the smaller amplitude.

As an additional or alternative criterion, the amplitude of the signals (for each bin) may be compared to a predetermined threshold value. If the signals are below a lower (or second) threshold, the system may not modify the phase. In some systems, the signals are summed for each bin to obtain an output signal $Out(\kappa,\nu)$ in the frequency domain. The signals may then be converted to the time domain by an inverse Fourier transform device 212.

In alternative systems, the above-described amplitude criterion may be used independent of the correlation and delay compensation performed in devices 106 to 116. Instead, the signals $x_L[n]$ and $x_R[n]$ may be passed directly to device 204 and 206. A phase correct addition or summing through the amplitude criterion is performed at mixer 202.

The FFT devices 204 and 206 may apply an overlap-add method. When processing audio signals which may have a sample rate of about 44100 Hz, for example, a Hamming window may filter both input signals and the output signal. In some applications the length of the Fast Fourier Transform may be equal to 512, the overlap may be equal to 64 samples corresponding to 87.5%.

The phase of the output signal may correspond to the phase of the second signal when the amplitude of the second signal is larger than a predetermined threshold value and/or larger than the amplitude of the first signal by a predetermined threshold value. For example, when the threshold value used to compare the amplitudes of the first and second signal bins is about −1 dB, artifacts and distortion may be minimized.

Figure 3:
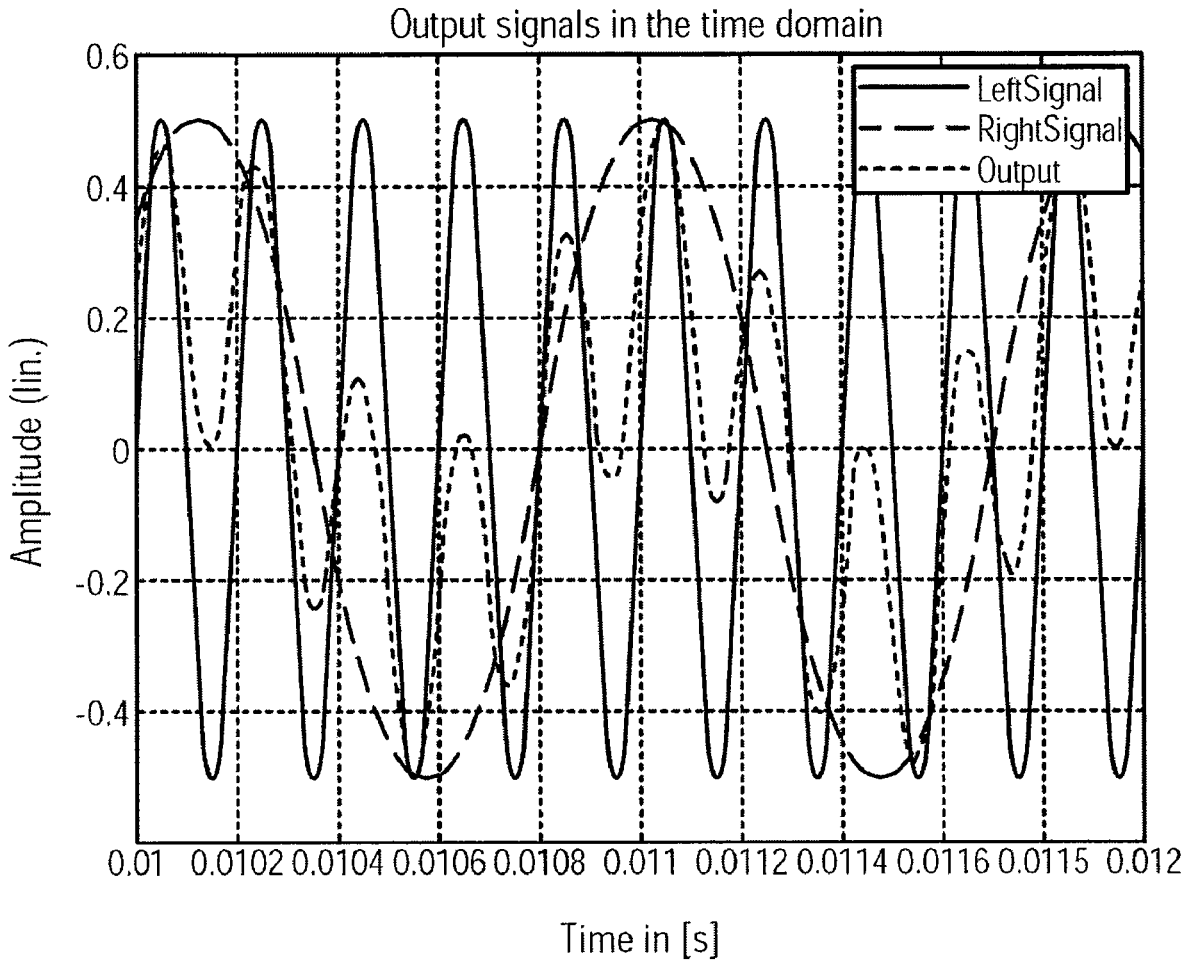
FIG. 3 is an exemplary output in the time domain.
Figure 4:
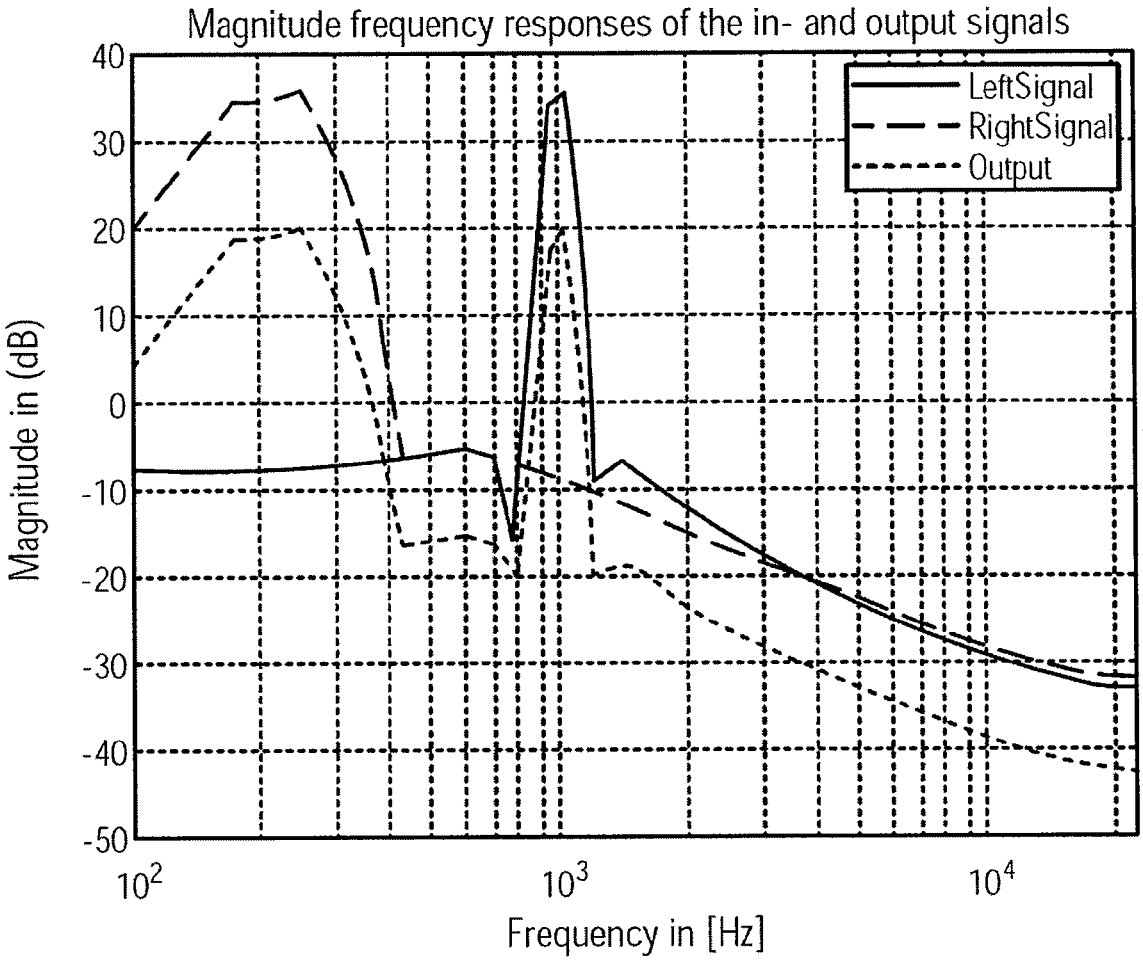
FIG. 4 is a magnitude and frequency responses of input and output signals.
Figure 5:
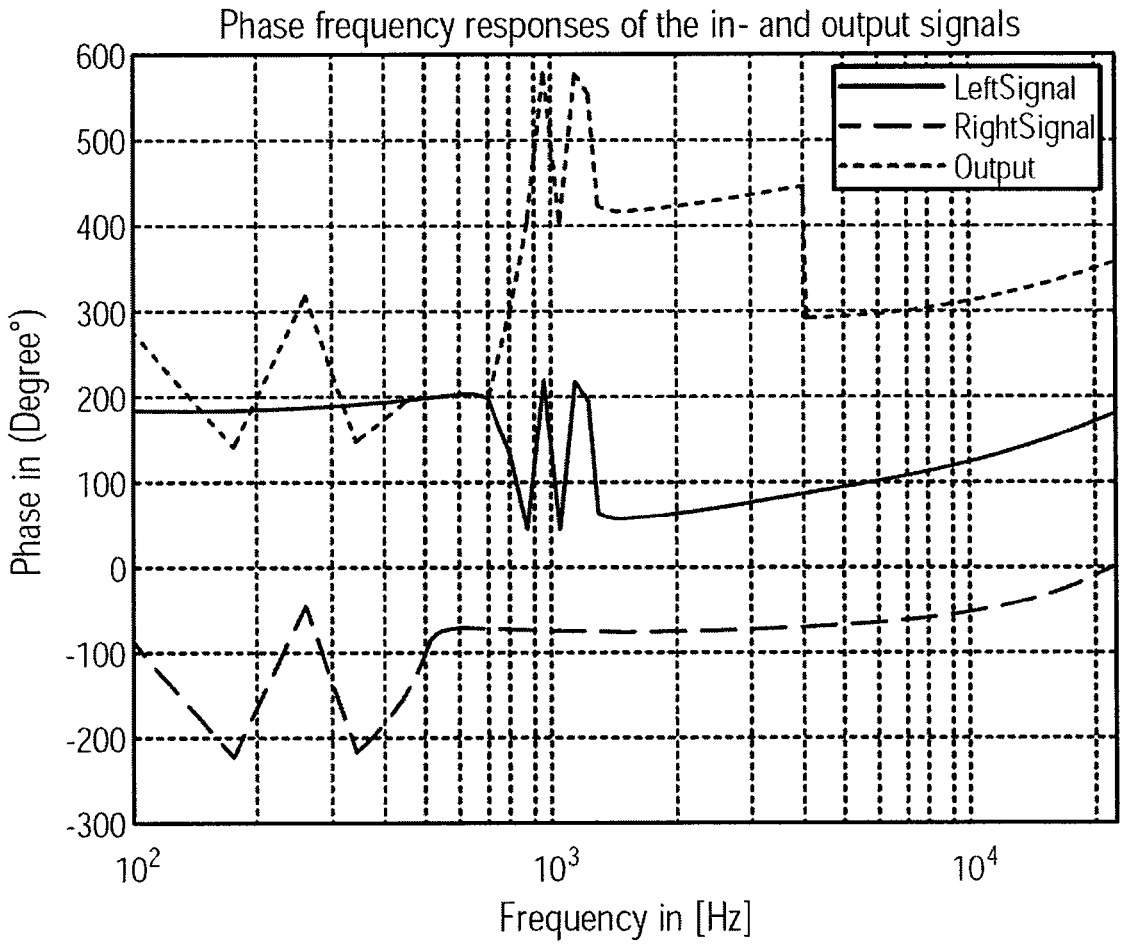
FIG. 5 is the frequency responses of input and output signal.

FIG. 3 is an exemplary output in the time domain. The output signal in this figure does not show detectable audible artifacts that correspond to the desired combination of the first and second input signal. The corresponding magnitude frequency responses are shown in FIG. 4.

The phase frequency response of the output signal corresponds (up to a frequency of about 800 Hz) to the phase frequency response of the second audio signal. In this frequency range, the amplitude of the second audio signal in this frequency range is larger than that of the first audio signal. Above a frequency of about 800 Hz, the phase of the output signal corresponds to the phase of the first audio signal as the first audio signal has a higher amplitude in this frequency range. Thus, the resulting output signal does not show any perceptible disturbances or audible artifacts. When the acoustically dominant spectral parts are played back, they are received with a correct phase.

If the comparative signal becomes very small or even vanishes, the adaptation of the filter coefficients of filter 106 might stop in some alternative applications. This condition may cause the filter coefficients to become static. When filter coefficients do not change, the position of the maximum value will remain at a same position. In this state a correlating condition may not be detected and the values for the delay of the signals and the sign for the phase compensation may not be accurate. To avoid this condition, alternative systems may add a small noise signal (e.g., having an amplitude of about −80 dB) to the comparative signal. When the comparative signal is sourced with a biasing signal, the comparative signal may not drop below this threshold which may ensure that the filter coefficients change.

In another alternative, the adaptive filters 106 may be programmed or configured so that an adaptation occurs only when the comparative signal (possibly after some smoothing) is equal to or larger than a predetermined threshold such as about −80 dB. In this condition, the delay values and the sign determined before will be maintained during interruption of the adaptation and are available when resuming the adaptation as soon as the comparative signal again rises above the threshold. These parameters may be applied immediately to a next track. If the delay of a second track (after resumption) deviates from the delay of the first track, after the analysis time (such as about 0.25 s), the system may determine that the tracks are non-correlated. When a number of L positions of maximum values has been processed (to represent correlated signals), the correct delay and sign may be applied again.

Other alternate systems and methods may include combinations of some or all of the structure and functions described above or shown in one or more or each of the figures. These systems or methods are formed from any combination of structures and function described or illustrated within the figures.

The methods, systems, and descriptions above may be encoded in a signal bearing storage medium, a computer readable medium or a computer readable storage medium such as a memory that may comprise unitary or separate logic, programmed within a device such as one or more integrated circuits, or processed by a controller or a computer. If the methods or system descriptions are performed by software, the software or logic may reside in a memory resident to or interfaced to one or more processors or controllers, a communication interface, a wireless system, body control module, an entertainment and/or comfort controller of a vehicle or non-volatile or volatile memory remote from or resident to the a speech recognition device or processor. The memory may retain an ordered listing of executable instructions for implementing logical functions. A logical function may be implemented through digital circuitry, through source code, through analog circuitry, or through an analog source such as through an analog electrical, or audio signals.

The software may be embodied in any computer-readable storage medium or signal-bearing medium, for use by, or in connection with an instruction executable system or apparatus resident to a vehicle, audio system, or a hands-free or wireless communication system. Alternatively, the software may be embodied in a navigation system or media players (including portable media players) and/or recorders. Such a system may include a computer-based system, a processor-containing system that includes an input and output interface that may communicate with an automotive, vehicle, or wireless communication bus through any hardwired or wireless automotive communication protocol, combinations, or other hardwired or wireless communication protocols to a local or remote destination, server, or cluster.

A computer-readable medium, machine-readable storage medium, propagated-signal medium, and/or signal-bearing medium may comprise any medium that contains, stores, communicates, propagates, or transports software for use by or in connection with an instruction executable system, apparatus, or device. The machine-readable storage medium may selectively be, but not limited to, an electronic, magnetic, optical, electromagnetic, infrared, or semiconductor system, apparatus, device, or propagation medium. A non-exhaustive list of examples of a machine-readable medium would include: an electrical or tangible connection having one or more links, a portable magnetic or optical disk, a volatile memory such as a Random Access Memory "RAM" (electronic), a Read-Only Memory "ROM," an Erasable Programmable Read-Only Memory (EPROM or Flash memory), or an optical fiber. A machine-readable medium may also include a tangible medium upon which software is printed, as the software may be electronically stored as an image or in another format (e.g., through an optical scan), then compiled by a controller, and/or interpreted or otherwise processed. The processed medium may then be stored in a local or remote computer and/or a machine memory.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method that automatically mixes a first audio signal and a second audio signal; comprising:

determining whether the first signal and the second signal are correlated according to a predetermined correlation criterion, and if the predetermined correlation criterion is fulfilled, determining whether the first and the second signal are delayed with respect to each other;

compensating for a delay of the first signal or the second signal; and mixing the first signal and the second signal, where the first signal or second signal includes a compensation;

where one of the first signal and the second signal is selected as a reference signal and the other signal is selected as a comparative signal; and where determining whether the signals are correlated comprises:

providing an adaptive filter that selectively passes portions of the reference signal; where the adaptive filter is configured such that the difference between the reference signal and the comparative signal is minimized according to a predetermined criterion;

determining a maximum value of the absolute values of the filter coefficients of the adaptive filter;

determining whether the filter coefficient position of the maximum value and the positions of a predetermined number of previously determined maximum values deviate at most by a predetermined threshold value from each other; and where the first and the second signal are designated to be correlated when the positions of the maximum values deviate at most by the predetermined threshold value from each other.

2. The method of claim 1 where determining whether the signals are correlated comprises determining a cross-correlation of the first signal and the second signal.

3. The method of claim 1 where determining whether the signals are delayed comprises:

providing a delay element configured to delay the comparative signal by about one half of the length of the adaptive filter to obtain a delayed comparative signal;

where the adaptive filter is configured to minimize the difference of the reference signal and the delayed comparative signal according to the predetermined criterion; and determining whether the filter coefficient position of the maximum value is located above or below half of the filter length of the adaptive filter.

4. The method of claim 3 where determining whether the filter coefficient position of the maximum value is located above or below comprises:

determining a median of the current and a predetermined number of previously determined positions of the maximum value; and determining the difference of the median and the value of half of the filter length.

5. The method of claim 1 further comprising determining whether the second signal is in phase or out of phase with respect to the first signal and if the second signal is out of phase, changing the phase of one of the signals.

6. The method of claim 1 where determining whether the signals are correlated and the act of compensating for a delay occurs only when the comparative signal exceeds a predetermined threshold.

7. The method of claim 1 where determining whether the signals are correlated occurs as at a synchronous interval.

8. The method of claim 3 where the act of determining whether the signals are correlated and the act of compensating for a delay occurs in a time domain.

9. The method of claim 1 further comprising:

transforming the first signal and the second signal into a plurality of frequency bins in a frequency domain; and for each frequency bin, determining whether the amplitude of the second signal fulfils a predetermined amplitude criterion; and where the act of mixing occurs for each frequency bin and that; if the predetermined amplitude criterion is fulfilled; the phase of the output signal for the respective frequency bin corresponds to the phase of the second signal.

10. The method of claim 9 where the predetermined amplitude criterion comprises verifying whether the amplitude of the second signal is larger than a predetermined threshold value or larger than the amplitude of the first signal by a predetermined threshold value.

11. The method of claim 9 where the output signal is based on a sum of the second signal and the second signal weighted by the ratio of the absolute values of the first and the second signal.

12. The method of claim 9 where the act of transforming comprises executing a short-time Fourier transform.

13. The method of the claim 9 the phase of the output signal corresponds to the phase of the first signal when the predetermined amplitude criterion is not fulfilled.

14. A non-transitory computer program product comprising a computer storage medium retaining computer-executable instructions that comprises:

determining whether the first signal and the second signal are correlated according to a predetermined correlation criterion, and if the predetermined correlation criterion is fulfilled, determining whether the first and the second signal are delayed with respect to each other by:

selectively passing portions of the reference signal through an adaptive filter configured such that the difference between the reference signal and the comparative signal is minimized according to the predetermined criterion;

determining a maximum value of the absolute values of the filter coefficients of the adaptive filter;

determining whether the filter coefficient position of the maximum value and the positions of a predetermined number of previously determined maximum values deviate at most by a predetermined threshold value from each other; and where the first and the second signal are designated to be correlated when the positions of the maximum values deviate at most by the predetermined threshold value from each other;

compensating for a delay of the first signal or the second signal;

mixing the first signal and the second signal.

15. A system that automatically mixes a first audio signal and a second audio signal; comprising;

a correlator that determines whether the first signal and the second signal are correlated according to a predetermined correlation criterion, and if the predetermined correlation criterion is fulfilled, determining whether the first and the second signal are delayed with respect to each other;

a delay circuit that compensates for the delay of the first signal or the second signal; and a mixer that mixes the first signal and the second signal, where the first signal or second signal includes a temporal compensation;

where one of the first signal and the second signal is selected as a reference signal and the other signal is selected as a comparative signal, and where the correlator comprises:

an adaptive filter that selectively passes certain elements of the reference signal, where the adaptive filter is configured to minimize the difference between the reference signal and the comparative signal according to a predetermined criterion;

a controller that processes filter coefficients of the adaptive filter, where the controller is configured to:

determine a maximum value of the filter coefficients;

determine whether the filter coefficient position of the maximum value and the positions of a predetermined number of previously determined maximum values deviate at most by a predetermined threshold value from each other; and determine if the first and the second signal are correlated by determining if the positions of the maximum values deviate at most by the predetermined threshold value.

16. The system of claim 10 where the a correlator comprises a delay element configured to delay the comparative signal by about half of the length of the adaptive filter; and where the control element is configured to determine whether the filter coefficient position of the maximum value is located above or below about half of the filter length of the adaptive filter.

17. The system of claim 16 comprising a phase detector that determines whether the second signal is in phase or out of phase with the first signal and; if the second signal is out of phase; initiates a changing of the phase.

18. The system of claim 16 further comprising:

transforming means for transforming the first signal and the second signal into the frequency domain;

amplitude criterion means for determining for each frequency or frequency range out of a set of frequencies or frequency ranges whether the amplitude of the second signal fulfills a predetermined amplitude criterion; and where the mixer is configured to mix the first signal and the second signal such that; for each frequency or frequency range of the set; if the predetermined amplitude criterion is fulfilled; the phase of the output signal corresponds to the phase of the second signal.

* * * * *

UNITED STATES PATENT AND TRADEMARK OFFICE

CERTIFICATE OF CORRECTION

PATENT NO. : 8,160,278 B2
APPLICATION NO. : 12/269391
DATED : April 17, 2012
INVENTOR(S) : Markus Christoph et al.

It is certified that error appears in the above-identified patent and that said Letters Patent is hereby corrected as shown below:

In the Claims

In column 13, claim 16, line 22, after "The system of" replace "claim 10 where the a correlator" with --claim 15 where the correlator--.

Signed and Sealed this
Fourth Day of December, 2012

David J. Kappos

David J. Kappos
*Director of the United States Patent and Trademark Office*